US011441431B2

(12) United States Patent
Delaporte et al.

(10) Patent No.: US 11,441,431 B2
(45) Date of Patent: Sep. 13, 2022

(54) HOLDING SYSTEM FOR THE DISMANTLING OF A BLADE WHEEL

(71) Applicant: SAFRAN AIRCRAFT ENGINES, Paris (FR)

(72) Inventors: Nicolas Daniel Delaporte, Moissy-Cramayel (FR); Alain Dominique Gendraud, Moissy-Cramayel (FR); Emmanuel Bernard Marie Charrier, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/973,663

(22) PCT Filed: Jun. 6, 2019

(86) PCT No.: PCT/FR2019/051351
§ 371 (c)(1),
(2) Date: Dec. 9, 2020

(87) PCT Pub. No.: WO2019/239036
PCT Pub. Date: Dec. 19, 2019

(65) Prior Publication Data

US 2021/0254481 A1 Aug. 19, 2021

(30) Foreign Application Priority Data

Jun. 12, 2018 (FR) ..... 1855124

(51) Int. Cl.
*F01D 5/30* (2006.01)
*F01D 25/28* (2006.01)

(52) U.S. Cl.
CPC ..... *F01D 5/3007* (2013.01); *F01D 25/285* (2013.01); *F05D 2230/70* (2013.01); *F05D 2260/30* (2013.01)

(58) Field of Classification Search
CPC ..... F01D 5/3007; F01D 5/005; F01D 5/3015; F01D 25/285; F05D 2230/70; F05D 2260/30; B23P 6/002; Y10T 29/49318
See application file for complete search history.

(56) References Cited

U.S. PATENT DOCUMENTS 4,836,518 A * 6/1989 Janutta ..... B23Q 3/063 269/37
5,026,032 A 6/1991 Ortolano et al.
(Continued)

FOREIGN PATENT DOCUMENTS

EP 1486291 A1 12/2004
FR 2604936 A1 4/1988
FR 3008448 A1 1/2015

OTHER PUBLICATIONS

Search Report dated Feb. 13, 2019, in FR Application No. 1855124 (2 pages).
(Continued)

*Primary Examiner* — Woody A Lee, Jr.
*Assistant Examiner* — Eric A Lange
(74) *Attorney, Agent, or Firm* — Bookoff McAndrews, PLLC.

(57) ABSTRACT

The present disclosure relates to a holding system for the dismantling of a blade wheel, the blade wheel comprising: a disc, a plurality of blades configured to be mounted circumferentially around the disc, the plurality of blades defining a plurality of inter-blade spaces, each of the inter-blade spaces being defined circumferentially between two adjacent blades of the plurality of blades, the holding system comprising a plurality of inserts, each of the inserts being
(Continued)

configured to be inserted into each of the inter-blade spaces in a holding position so as to hold the relative position of the blades when the plurality of blades is dismantled from the disc.

14 Claims, 5 Drawing Sheets

(56) References Cited

U.S. PATENT DOCUMENTS

| | | | | |
|---|---|---|---|---|
| 6,736,706 | B1 * | 5/2004 | Pan | B24C 3/327 451/36 |
| 9,328,621 | B2 * | 5/2016 | Lecuyer | B23P 19/10 |
| 2019/0101012 | A1 * | 4/2019 | Kolvick | F01D 25/285 |

OTHER PUBLICATIONS

International Search Report issued in International Application No. PCT/FR2019/051351 dated Oct. 18, 2019 (2 pages).

* cited by examiner

HOLDING SYSTEM FOR THE DISMANTLING OF A BLADE WHEEL

CROSS-REFERENCE TO RELATED APPLICATION(S)

This application is the U.S. national phase entry under 35 U.S.C. § 371 of International Application No. PCT/FR2019/051351, filed on Jun. 6, 2019, which claims priority to French Patent Application No. 1855124, filed on Jun. 12, 2018.

TECHNICAL FIELD

The present disclosure relates to a holding system for the dismantling of a blade wheel and a method for dismantling a blade wheel.

TECHNOLOGICAL BACKGROUND

Known from the prior art, particularly from document FR 3 008 448, is a turbine rotor comprising a moving blade wheel 1, i.e. configured to be driven in rotation around the axis of the rotor, shown in FIG. 1, forming a crown, and which comprises a disc 2 around which are mounted circumferentially a set of blades 3. It is also known to axially hold the blades 3 by means of a holding ring 17. In operation, the holding ring 17 is subject to more rapid wear than the disc 2. It is therefore to be replaced more regularly. However, to reach the holding ring 17, and to be able to replace it, it is necessary to withdraw the blade wheel disposed downstream of the blade wheel which comprises the used holding ring. However, to withdraw the blades of the different moving blade wheels disposed downstream, it is necessary to withdraw, one by one, the blades from the discs, then, once the holding ring is replaced, reassemble the blades one by one to the blades of the moving blade wheels. An operation of this type is time-consuming and represents a considerable cost.

PRESENTATION

The present disclosure aims to resolve all or part of the disadvantages mentioned above.

To this end, the present disclosure relates to a holding system for the dismantling of a blade wheel, the blade wheel comprising:

- a disc,
- a plurality of blades configured to be mounted circumferentially around the disc, the plurality of blades defining a plurality of inter-blade spaces, each of the inter-blade spaces being defined circumferentially between two adjacent blades of the plurality of blades, the holding system comprising a plurality of inserts, each of the inserts being configured to be inserted into each of the inter-blade spaces in a holding position so as to hold the relative position of the blades when the plurality of blades is dismantled from the disc.

The axis of symmetry (or quasi-symmetry) of the blade wheel is called its axis. This axis corresponds to the axis of rotation of the blade wheel. The axial direction corresponds to the direction of the axis of the blade wheel and a radial direction is a direction perpendicular to the axis of the blade wheel and intersecting this axis. Likewise, an axial plane is a plane containing the axis of the blade wheel and a radial plane is a plane perpendicular to this axis.

A circumference is understood to be a circle belonging to a radial plane, the center of which belongs to the axis of the blade wheel. A circumferential direction is a direction following a circumference.

Unless otherwise stated, the adjectives inner/internal and outer/external are used with reference to a radial direction so that the inner portion of an element is, in a radial direction, closer to the axis of the blade wheel than the outer portion of the same element.

Thanks to these dispositions it is possible to gain access to the holding ring by dismantling the disc of a given blade wheel, without having to dismantle the moving blade wheels disposed downstream. Thus, a time saving is obtained for gaining access to a damaged holding ring carried by this given movable blade wheel. In fact, the relative position of the blades being held, it is possible to dismantle and reassemble all the blades on the disc in a single operation, without having to dismantle or reassemble them one by one. Thus, the dismantling and reassembly of the blade wheel is more rapid and more effective. In addition, the inserts taking up the forces exerted on the disc, the disc can be more easily dismantled.

The holding position is located at a predetermined height of the inter-blade space in the radial direction.

When an insert is located in the holding position, the center of the insert in the radial direction is located at the predetermined height.

For example, the holding position of the inserts is preferably closest to the disc, in order to better hold the blades.

In certain embodiments, the blade wheel also comprises a holding ring configured to axially hold the blades on the disc.

In certain embodiments, each blade of the plurality of blades comprises a root, an airfoil and a tip, disposed in that order in a longitudinal direction of the blade. When the blade is mounted on the disc, the longitudinal direction of the blade corresponds to the radial direction.

In certain embodiments, the holding position of the inserts is located at an inner portion of the inter-blade space, defined between the blade root and the center of the inter-blade space in a radial direction.

It is understood that at least one portion of each insert has a shape corresponding to the inter-blade space, defined between two adjacent blades. Moreover, at least one portion of the inserts conforms to the shape of a portion of the blades of two adjacent blades.

It is understood that, in the holding position, each insert is disposed against, and preferably directly against, each of the adjacent blades defining the inter-blade space.

In certain embodiments, each of the inserts comprises at least one portion of an aluminum-based alloy, and/or a polymer having a Shore A hardness comprised between 75 and 100.

What is meant by "based on" is an alloy comprising at least 50% by mass of aluminum.

For example, the inserts could comprise a portion comprising an aluminum-based alloy covered with a polymer.

For example, the polymer is a resin.

It is understood that the at least one portion comprising aluminum, or a polymer having a Shore A hardness comprised between 75 and 100, is a portion in contact with a blade.

For example, the at least one portion consists of an aluminum-based alloy, and/or a polymer having a Shore A hardness comprised between 75 and 100.

It is understood that the material forming the blade is less soft than the aluminum-based alloy and/or the polymer having a Shore A hardness comprised between 75 and 100.

Thus, when the inserts are installed in their holding position, the risk of damaging the blades, which are formed in a harder material than the portions of the inserts in contact with the blades, is more limited.

In certain embodiments, the inserts have a thickness in a radial direction greater than or equal to 10% of the height of an airfoil of a blade in the radial direction.

What is meant by the height of an airfoil of a blade is the greatest distance between a platform of the blade root and a platform of the blade tip.

Thus, sufficient contact surfaces with the blades are guaranteed and the holding of the position of the blades relative to one another is more effective.

For example, the thickness is approximately 10 mm, for an airfoil height of approximately 100 mm.

In certain embodiments, the insert comprises a first portion and a second portion. The first portion is the portion of the insert intended to be inserted into the inter-blade space. The second portion serves, for example, for the mounting of the insert. The greater length in an axial direction of the first portion is comprised between 10 mm and 20 mm, i.e. representing between 70% and 100% of the length of the airfoil of the blade in the axial direction.

In certain embodiments, the holding system comprises a grip portion configured to be mounted on an insert of the plurality of inserts, the grip portion being configured to allow the gripping of the insert and facilitate the mounting of the insert in an inter-blade space.

Thus, the manipulation of the inserts during their insertion into the inter-blade space is facilitated.

For example, the grip portion can allow the inserts to be directly mounted at their holding position, by a movement which follows the shape of the insert. In fact, the grip portion can form a lever arm which thus allows being able to exert a sufficient force on the insert to insert it directly in the holding position.

In certain embodiments, the holding system comprises a device for positioning the plurality of inserts, each insert of the plurality of inserts being configured to be applied to the positioning device so as to hold the inserts in position, i.e. so that the inserts are disposed in the holding position.

Thus, the inserts are substantially aligned in a circumferential direction, which allows balancing the forces exerted on the blades, and also holding more effectively the position of the blades relative to one another, and will facilitate the dismantling of the disc.

For example, the positioning device allows slightly different holding positions of the inserts in the radial direction, so as to compensate the dimensional tolerances/dispersions of the blades.

What is meant by "substantially" or "slightly" is that the real height in the radial direction of the inserts in their holding position differs by at most 5% relative to the predetermined height.

The positioning device allows the radial blockage of the inserts, which allows guaranteeing the integrity of the assembly comprising the blades and the inserts, particularly when the disc is dismantled.

In certain embodiments, the positioning device comprises a positioning ring, the positioning ring comprising fastening elements to allow the fastening of the inserts on the positioning ring.

Thus, the inserts are held in their holding position, which allows holding more effectively the relative position of the blades.

It is understood that the positioning device is annular.

In certain embodiments, the fastening elements allow the fastening of inserts to the positioning ring.

In certain embodiments, the fastening devices of the positioning device are intended to be disposed facing the inserts when the inserts are in the holding position, to allow the fastening of the inserts to the positioning device.

For example, the fastening elements comprise oblong openings each leading to face an inter-blade space. For example, the oblong openings extend in the radial direction so as to allow a slightly different positioning of the inserts relative to one another in the radial direction.

For example, each of the inserts comprises a blind hole extending in the axial direction. The blind hole is intended to face the oblong opening when the insert is in the holding position.

For example, a fastening member allows fastening the insert to the positioning ring, by cooperating with the blind hole.

For example, the blind hole is reamed and the fastening member is threaded.

For example, the fastening members are threaded and are configured to cooperate with reamed blind holes present in each of the inserts. In addition, the fastening members are configured to hold the inserts against the positioning ring, for example thanks to an abutment element, such as a screw head.

In certain embodiments, each of the inserts comprises a first member and a second member, the first and second members being configured to be disposed in an inter-blade space, the first member being disposed against a first blade, and the second member being disposed against a second blade circumferentially adjacent to the first blade; and a clamping part, configured to be inserted between the first and second members so as to hold the insert between the first and second blades.

For example, the clamping part is configured to be inserted between the first and second members in the axial direction.

Thus, the mounting of the inserts can be accomplished axially when radial mounting is difficult to accomplish under certain circumstances. This embodiment of the inserts also allows adjusting the clamping to each inter-blade space, depending on the insertion of the clamping part.

For example, the holding system comprises an abutment disc, allowing the positioning of the inserts.

In certain embodiments, at least one of the first and second members comprises a guide surface, configured to guide the clamping part during its insertion between the first and second members and to avoid the radial movement of the clamping part.

In certain embodiments, the clamping part comprises an abutment configured to come into contact with the first and second members when the clamping part is mounted between the first and second members.

In certain embodiments, the clamping part has a wedge, beveled, conical or rectangular shape.

The present disclosure also relates to a method for dismantling a blade wheel comprising a disc and a plurality of blades mounted circumferentially around the disc, the plurality of blades defining a plurality of inter-blade spaces, each of the inter-blade spaces being defined circumferentially between two adjacent blades of the plurality of blades, the dismantling method comprising the following steps:

A. inserting a plurality of inserts of a holding system into the inter-blade spaces in a holding position so that the relative position of the blades is held;

B. withdrawing the disc.

Thanks to these dispositions, it is possible to gain access to the holding ring by dismantling the disc from a given moving blade wheel, without having to dismantle the moving blade wheels disposed downstream. Thus, a time saving is obtained for gaining access to a holding ring carried by this given moving blade wheel. In fact, the relative position of the blades being held, it is possible to dismantle and reassemble all the blades to the disc in a single operation, without having to dismantle or reassemble them one by one. Thus, the dismantling and reassembly of the blade wheel is more rapid and more effective. In addition, because the inserts take on the forces exerted on the disc, the disc is easier to dismantle.

In certain embodiments, the method also comprises the following steps:

replacing a holding ring configured to hold the position of the blades in an axial direction, re-engaging the blades on the disc, withdrawing the holding system from the blade wheel.

In certain embodiments, during step A:

the inserts are inserted at a radially outer portion of the inter-blade spaces, and the inserts are moved in a radial direction, radially inward, until they reach the holding position.

Thus, it is possible to adjust the position of the inserts depending on the force that it is desired to apply to the blades and depending on the dimensional tolerances/dispersions of the blades.

According to one variant, the inserts are inserted directly at their holding position, thanks to a grip portion, by a movement which follows the shape of the insert. In fact, the grip portion can form a lever arm which thus allows being able to exert a sufficient force on the insert to insert it directly into the holding position.

In certain embodiments, each of the inserts comprises a first member, a second member and a clamping part; during step A:

the first member of an insert is disposed, in an inter-blade space, against a first blade at the holding position, the second member of the insert is disposed, in the inter-blade space, against a second blade, adjacent to the first blade, so that the second member is disposed circumferentially facing the first member, the clamping part is inserted between the first and second members so as to hold the insert in the holding position.

Thus, the mounting of the inserts can be accomplished axially if radial mounting is difficult to accomplish under certain circumstances.

For example, to position the inserts in the holding position, it is possible to dispose a positioning device at the holding position of the inserts.

For example, the positioning device comprises a positioning ring, and the positioning ring is positioned so that the fastening elements, for example oblong openings, are located at the holding position of the inserts. Thus, when the inserts are mounted, and are facing the fastening elements, it is possible to fasten the inserts to the positioning ring.

For example, the inserts are fastened to the positioning ring thanks to the fastening elements.

BRIEF DESCRIPTION OF THE DRAWINGS

The invention and its advantages will be better understood upon reading the detailed description given hereafter of different embodiments given by way of non-limiting examples. This description refers to the appended pages of figures, in which.

DETAILED DESCRIPTION

Figure 1:
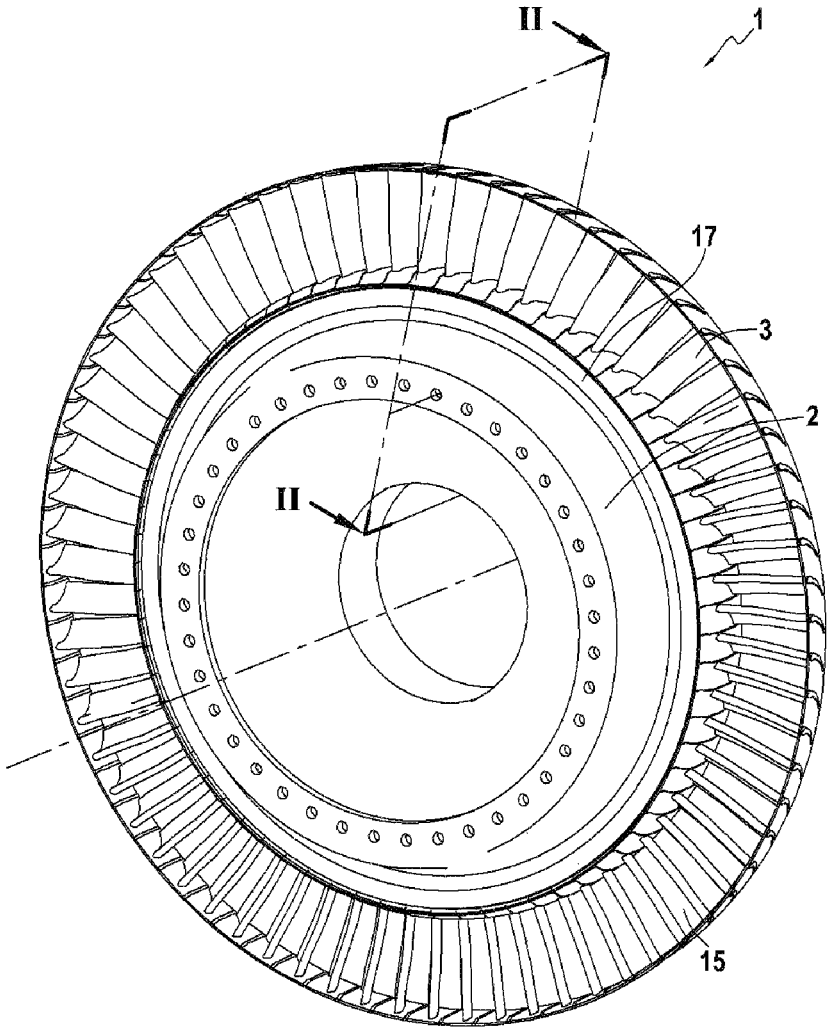
FIG. 1 shows a blade wheel.

FIG. 1 shows a blade wheel 1. For example, the blade wheel 1 is installed in the low-pressure turbine of a turbomachine.

The blade wheel 1 comprises a disc 2 and a plurality of blades 3. The plurality of blades 3 is mounted on the disc 2 around its circumference.

Figure 2:
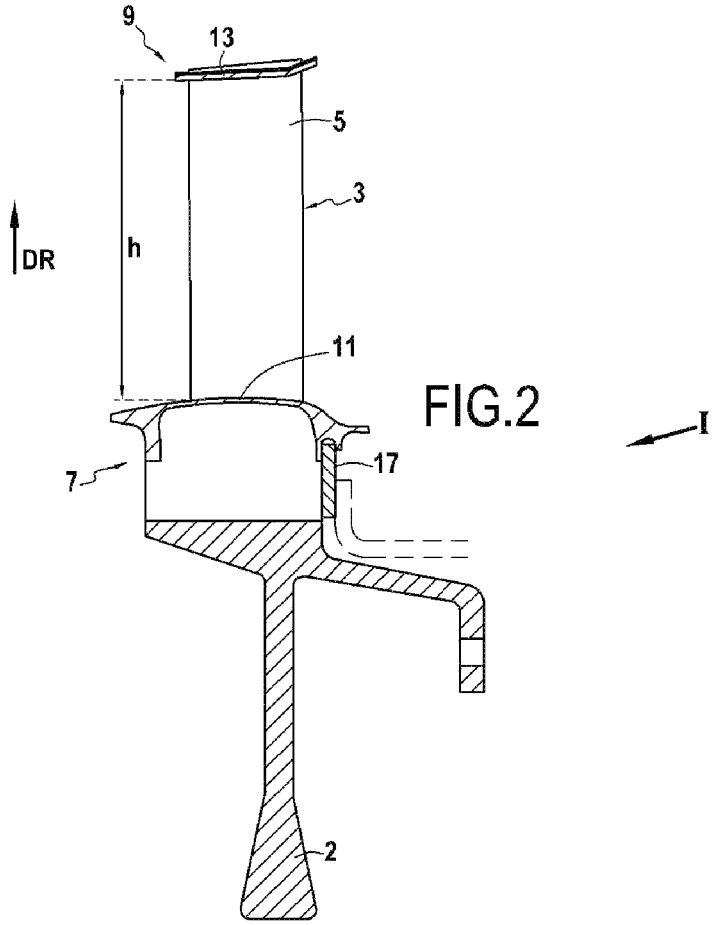
FIG. 2 shows a section view of the blade wheel in the plane II-II of FIG. 1.

FIG. 2 is a section of the blade wheel 1 in a plane II-II shown in FIG. 1. The blade 3 shown in FIG. 2 comprises an airfoil 5, a blade root 7 and a blade tip 9. The blade root 7 comprises a radially inner platform 11. The blade tip 9 comprises a radially outer platform 13. The airfoil 5 extends radially between the platforms 11, 13. All the blades 3 of the plurality of blades are similar to the blade shown in FIG. 1. Each of the airfoils 5 of the blades 3 has a concave face and a convex face.

When they are mounted on the disc 2, the blades 3 extend in a radial direction DR and are spaced from one another so as to define inter-blade space 15, visible in FIG. 1 for example. It is understood that an inter-blade space 15 is defined between two adjacent blades 3. The distance between two airfoils 5 of adjacent blades 3 is greater in proximity to the blade tips 9 than in proximity to the blade roots 7. Thus, the distance between two blade airfoils decreases between the blade tips 9 and the blade roots 7.

The blades 3 are mounted on the disc 2 in a nominal operating position.

FIGS. 1 and 2 also show a holding ring 17, configured to block axially the blades 3 on the disc 2.

Figure 3:
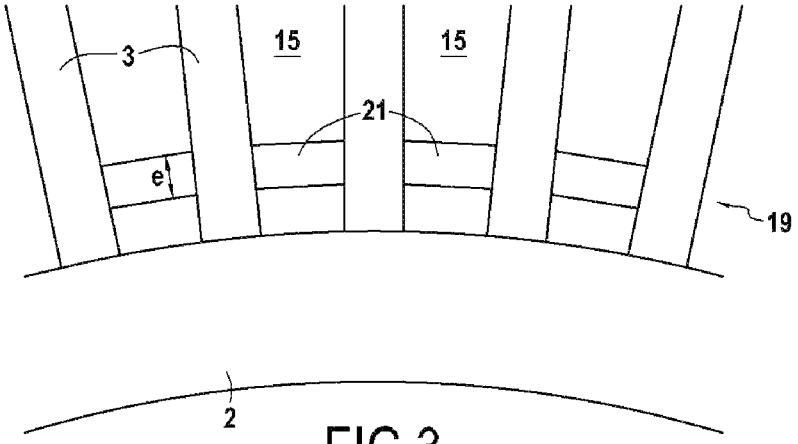
FIG. 3 shows a schematic view of a portion of a blade wheel in which are inserts are inserted into the inter-blade spaces.

FIG. 3 shows a portion of a blade wheel 1 and a holding system 19 for dismantling the blade wheel 1. The holding system 19 comprises a plurality of inserts 21. Here the inserts 21 are inserted into each of the inter-blade spaces 15 so as to hold the relative position of the blades 3 and allow the dismantling of the disc 1.

Figure 4:
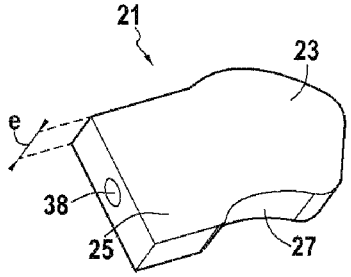
FIG. 4 shows an insert according to a first embodiment.
Figure 5:
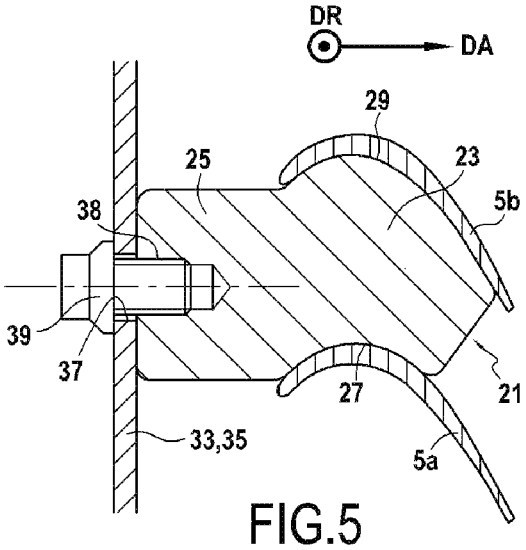
FIG. 5 shows an insert according to the first embodiment, mounted on the blade wheel and fastened to a positioning device.

An insert according to the first embodiment is shown in FIGS. 4 and 5.

The insert 21 comprises a first portion 23 and a second portion 25. The first portion 23 is configured to hold the relative position of the blades 3. The first portion 23 comprises a first contact surface 27, configured to come into contact with an airfoil 5*a* of a first blade 3*a* and to conform to the shape of the convex face of the airfoil 5*a*. Here, the first contact surface 27 therefore has a concave shape. In other words, the first contact surface 27 and the convex face of the airfoil 5*a* have complementary shapes.

The first portion 23 also comprises a second contact surface 29, configured to come into contact with an airfoil 5*b* of a second blade 3*b* and conform to the shape of the concave face of the blade 5*b*. Here, the second contact surface 29 therefore has a convex shape. In other words, the second contact surface 29 and the concave face of the airfoil 5*b* have complementary shapes. The first and second blades 3*a*, 3*b* are adjacent in the circumferential direction of the blade wheel.

The convex face of the airfoil 5*a* and the concave face of the airfoil 5*b* face one another in the circumferential direction. The surfaces of the airfoils 5*a*, 5*b* of the first and second blades 3*a*, 3*b* define the inter-blade space 15.

It is understood that the first portion 23 of the insert 21 has a shape corresponding to a portion of the inter-blade space 15, when the blades 3 are in the nominal position. Thus, when the inserts 21 are mounted in the inter-blade space 15 at a holding position, the blades of the blade wheel are held together via the inserts, which frees the stresses applied by the blade roots 7 at the alveoli of the disc in which are mounted the blade roots and thus allows easy assembly or dismantling of the disc.

For example, at least the portions of the first portion 23 of the insert 21 in contact with the airfoils 5*a*, 5*b* of the blades 3*a*, 3*b*, and preferably at least the first portion 23 of the insert 21, comprise an aluminum-based alloy, and/or a polymer having a Shore A hardness comprised between 75 and 100. For example, the polymer is a resin.

The dimension of the section of the first portion 23 of the insert 21 in a plane normal to the radial direction DR is greater than the dimension in this plane of the inter-blade space 15 in proximity to the blade roots 7. Thus, the insert 21, in the position holding the relative position of the blades 3, is positioned in the inter-blade space 15 at a portion having substantially the same dimension as the dimension of the section of the insert 21 in a plane normal to the radial direction DR.

Generally, the inserts 21 are disposed at a first end portion of the inter-blade space 15, defined, for each inter-blade space, between the blade root 7 and the center of the inter-blade space 15 in the radial direction DR.

The inserts 21, and more particularly their first portion 23, have a thickness e in the radial direction DR greater than or equal to 10% of the height h of the airfoil in the radial direction DR.

The holding position of each insert is located at a predetermined height of the inter-blade space 15, or of the adjacent airfoils 5. When the insert 21 is in the holding position, the center of the insert in the radial direction, i.e. a height of the insert corresponding to half its thickness e, is located at the predetermined height. Sometimes, due to the tolerances or dimensional dispersions of the blades, the height in the radial direction, corresponding to the holding position, is substantially different at the height determined for certain inserts. However, the difference between the real height of the holding position of the inserts 21 and the predetermined height is less than or equal to 5% of the total height of the airfoil 5, or of the inter-blade space 15.

For example, the thickness e is approximately 10 mm, for an airfoil height of approximately 100 mm. For example, the greatest length in an axial direction DA of the first portion 23 is 15 mm, i.e. between 70 and 100% of the length in an axial direction DA of the airfoil 5 of the blade 3.

The second portion 25 of the insert 21 is connected to the first portion 23 of the insert. For example, the first and second portion 23, 25 are formed together.

The second portion 25 extends, here, in the continuation of the first portion 23 in the axial direction DA. The second portion 25 supplies a gripping means allowing engaging or disengaging the insert 21 from the inter-blade space 15. The second portion 25 can also serve as a support for the mounting of the insert 21 to other elements.

Figure 6:
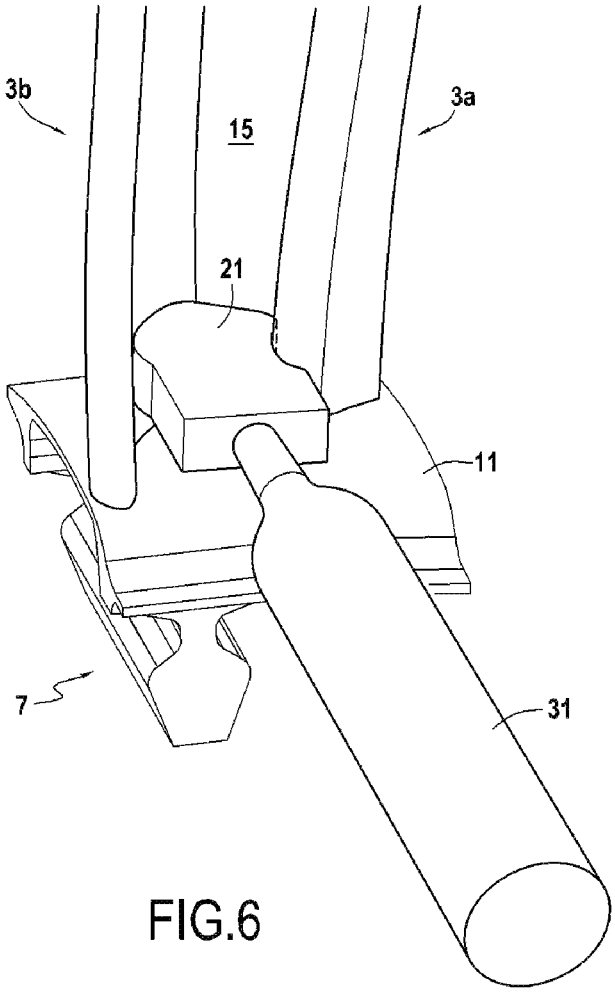
FIG. 6 shows an insert according to the first embodiment on which is mounted a grip portion.

For example, as shown in FIG. 6, the holding system 19 can also comprise a grip portion 31 of the inserts 21. The grip portion 31 can be mounted on the second portion 25. The grip portion 31 allows forming a sleeve, sufficiently long to allow a user to grasp it easily. Thus, the grip portion 31 allows facilitating the manipulation of the inserts 21 and their insertion into the inter-blade space 15. For example, the grip portion 31 is mounted removably on the second portion 25. In this manner, the user can use the same grip portion 31 for mounting all the inserts 21.

Figure 7:
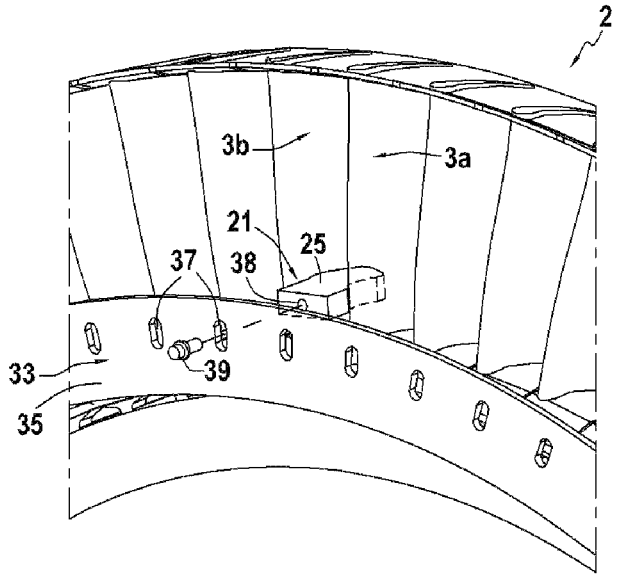
FIG. 7 shows a portion of the blade wheel, on which is mounted a holding system according to the first embodiment.

In addition, as shown in FIG. 7, the holding system 19 can comprise a positioning device 33. The positioning device 33 comprises, in this embodiment, a positioning ring 35 configured to be positioned against the blades 3, in a circumferential direction. The positioning ring 35 comprises oblong openings 37 leading to the inter-blade space 15. The oblong openings 37 extend in a radial direction DR so as to allow a slightly different positioning of the inserts 21 with respect to one another in the radial direction DR, so as to take into account dimensional tolerances/dispersions.

For example, the second portion 25 comprises a reamed blind hole 38 extending in the axial direction DA. The blind hole 38 is intended to face the oblong opening 37, when the inset 21 is in the holding position. A fastening member 39 allows fastening the insert 21 to the positioning ring 35. For example, as shown, the fastening member 39 is a screw, configured to be inserted into the reamed blind hole 38. However, the insert 21 could be fastened to the positioning ring 35 by any other means. In this manner, the inserts 21 are substantially aligned along the circumferential direction.

For the purpose of positioning the inserts 21 at the same radial height in the inter-blade spaces, according to another embodiment (not shown), an internal radial abutment disc could be provided at a predetermined height, corresponding to the holding position of the inserts 21. The second portion 25 of the inserts could then come into abutment against the internal disc. Once the plurality of inserts was mounted, an external radial blockage disc is positioned, allowing holding the position of the inserts 21.

The method of dismantling the blade wheel 2 according to the first embodiment is described hereafter.

Firstly, the inserts 21 are inserted, one by one, into each of the inter-blade spaces 15, in their holding position.

Figure 9:
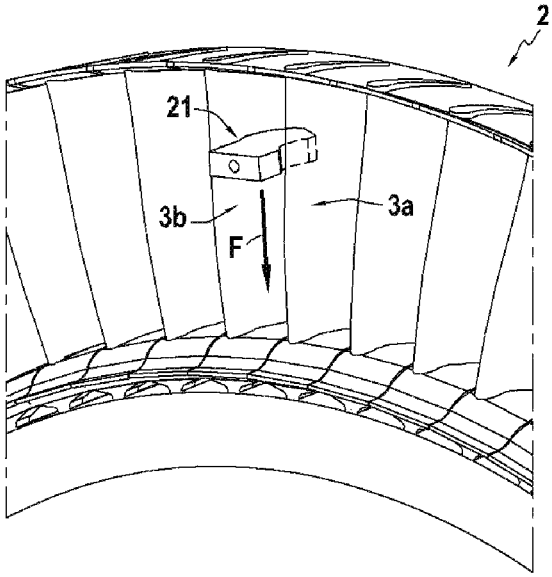
FIG. 9 shows a step in mounting an insert according to the first embodiment in an inter-blade space.

To this end, the inserts 21 are first inserted at an external portion of the inter-blade space 15, as shown in FIG. 9, then the inserts 21 are moved, for example by means of the grip portion 31, in the radial direction DR, according to arrow F, i.e. inward, until they reach the holding position. What is meant by the external portion of the inter-blade space 15 is a portion defined between the center of the airfoil 5 in the radial direction DR and the outer end of the airfoil 5.

According to one variant, the inserts 21 are disposed directly at their holding position by a movement that follows the shape of the first and second contact surfaces 27, 29, thanks to the grip portion 31 which forms, in this variant, a lever arm which thus allows exerting a sufficient force on the insert 21 to insert it directly into the holding position.

For example, to position and hold the inserts 21 in the holding position, it is possible to dispose the positioning ring 35 so that the oblong openings 37 are located at the holding position of the inserts 21. Thus, when the inserts are mounted, and face the oblong openings, they are fastened to the positioning ring 35, here by means of the fastening member 39 which can be inserted into the blind holes 37 of the inserts 21.

Once all the inter-blade spaces 15 of the blade wheel 1 are provided with an insert 21, it is possible to withdraw the disc 2. After having withdrawn the disc 2, it is possible, for example, to proceed with the replacement of the holding ring 17. Then it is possible to re-engage the disc 2 with all the blade roots 7 of the blades 3, because their relative position has been held by the inserts. Finally, once the blades 3 are re-mounted on the disc 2, it is possible to withdraw the holding system 19.

Figure 8:
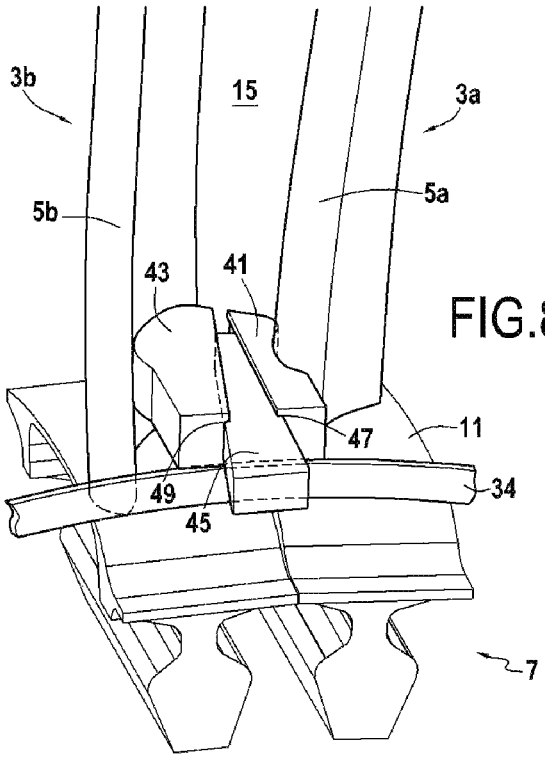
FIG. 8 shows a portion of the blade wheel, on which is mounted an insert according to the second embodiment.

A second embodiment of the holding system is shown in FIG. 8. Hereafter, common elements in the different embodiments are identified by the same numerical references. The second embodiment differs from the first embodiment in that each of the inserts 21 comprises a first member 41 and a second member 43. The first and second members 41, 43 are configured to be disposed in an inter-blade space 15. The first member 41 is disposed against the airfoil 5*a* of the first blade 3*a* and the second member 43 is disposed against the second airfoil 5*b* of the second blade 3*b*, circumferentially adjacent to the first blade 3*a*. The first and second members 41, 43 face one another in the circumferential direction of the blade wheel.

Each of the inserts 21 also comprises a clamping part 45, configured to be inserted, in the axial direction DA, between the first and second member 41, 43 so as to hold the first and second members 41, 43 against the airfoils 5*a*, 5*b*. In the exemplary embodiment shown, the clamping part 45 has the shape of a wedge or a bevel.

In order to guide the clamping part 45 between the first and second members 41, 43 during its insertion in the axial direction, and thereby avoid its radial movement, at least one of the first and second members 41, 43 comprises a guide surface. In the example shown, each of the first and second members 41, 43 comprises a guide surface.

Here, the guide surfaces are formed by the recesses 47, 49 provided in each of the first and second members 41, 43. The edges of the recesses 47, 49 allow the radial blockage of the clamping part 45 and guidance in axial translation of the clamping part 45.

In one embodiment, not shown, the clamping part 41 comprises an axial abutment configured to come into contact with the first and second members 41, 43 when the clamping part 45 is mounted between the first and second members 41, 43.

For example, in order to position the inserts 21 at the same radial height in the inter-blade space according to the embodiment shown in FIG. 8, an internal radial abutment disc 34 could be provided at a predetermined height, corresponding to the holding position of the inserts 21. The first and second members could be positioned in abutment against the internal disc 34, before the insertion of the clamping part.

The method of dismantling the blade wheel 1 thanks to a holding system according to the second embodiment is described hereafter.

Firstly, the inserts 21 are inserted, one by one, into each of the inter-blade spaces 15, in their holding position.

For this purpose, the first member 41 of an insert 21 is disposed against the airfoil 5*a* of the first blade 3*a*, at the holding position. Then, the second member 43 of the insert 21 is disposed against the airfoil 5*b* of the second blade 3*b*, circumferentially adjacent to the first blade 3*a*, also at the holding position, so that the second member 43 is disposed facing the first member 41 in the circumferential direction of the blade wheel. Then, the clamping part 45 inserted between the first and second members 41, 43.

Thus inserts 21 are inserted into each of the inter-blade spaces 15.

Once all the inter-blade space 15 of the blade wheel 1 are provided with an insert 21, in the same manner as in the first embodiment, the disc 2 can be withdrawn. After having withdrawn the disc 2, it is possible, for example to proceed with the replacement of the positioning ring 17. Then, the disc 2 can be easily re-engaged with all the blade roots 7 of the blades 3, because their relative position has been held by the inserts. Finally, once the blades 3 are re-mounted on the disc 2, it is possible to withdraw the holding system 19.

Although the present invention has been described by referring to specific embodiments, it is obvious that modifications and changes can be performed on these examples without departing from the general scope of the invention as defined by the claims. In particular, individual features of the different embodiments illustrated/mentioned can be combined into additional embodiments. Consequently, the description and the drawings must be considered in an illustrative, rather than a restrictive sense.

It is also obvious that all the features described with reference to a method are transposable, alone or in combination, to a device, and conversely all features described with reference to a device are transposable, alone or in combination, to a method.

The invention claimed is:

1. A holding system for the dismantling of a blade wheel, the blade wheel comprising:

a disc, a plurality of blades configured to be mounted circumferentially around the disc, the plurality of blades defining a plurality of inter-blade spaces, each of the inter-blade spaces being defined circumferentially between two adjacent blades of the plurality of blades, the holding system comprising a plurality of inserts, each of the inserts being configured to be inserted into each of the inter-blade spaces in a holding position so as to hold the relative position of the blades when the plurality of blades are dismantled from the disc, and wherein each of the inserts comprises at least one portion made of an aluminum-based alloy, and/or a polymer having a Shore A hardness between 75 and 100.

2. The holding system according to claim 1, wherein the inserts have a thickness in a radial direction greater than or equal to 10% of the height of an airfoil of a blade in the radial direction.

3. The holding system according to claim 1, comprising sleeve configured to be mounted on an insert of the plurality of inserts, the sleeve being configured to allow the gripping of the insert and facilitate the mounting of the insert in an inter-blade space.

4. The holding system according to claim 1, comprising a positioning ring, each insert of the plurality of inserts being configured to be applied to the positioning ring so as to hold the inserts in position.

5. The holding system according to claim 4, wherein the positioning ring comprises fastening elements to allow the fastening of the inserts on the positioning ring.

6. The holding system according to claim 1, wherein each of the inserts comprises:

a first member and a second member, the first and second members being configured to be disposed in an inter-blade space, the first member being disposed against a first blade, and the second member being disposed against a second blade circumferentially adjacent to the first blade; and a wedge or a bevel, configured to be inserted between the first and second members so as to hold the insert between the first and second blades.

7. A method for dismantling a blade wheel comprising a disc and a plurality of blades mounted circumferentially around the disc, the plurality of blades defining a plurality of inter-blade spaces, each of the inter-blade spaces being defined circumferentially between two adjacent blades of the plurality of blades, the dismantling method comprising the following steps:

A. inserting a plurality of inserts of a holding system into the inter-blade spaces in a holding position so that the relative position of the blades is held;

B. withdrawing the disc.

8. The method according to claim 7, wherein, during step A:

the inserts are inserted at a radially outer portion of the inter-blade spaces;

the inserts are moved in a radial direction, radially inward, until they reach the holding position.

9. The method according to claim 7, wherein each of the inserts comprises a first member, a second member and a wedge or a bevel, during step A:

the first member of an insert is disposed, in an inter-blade space, against a first blade at the holding position;

the second member of the insert is disposed, in the inter-blade space, against a second blade, adjacent to the first blade, so that the second member is disposed circumferentially facing the first member;

the wedge or the bevel is inserted between the first and second members so as to hold the insert in the holding position.

10. A holding system for the dismantling of a blade wheel, the blade wheel comprising:

a disc, a plurality of blades configured to be mounted circumferentially around the disc, the plurality of blades defining a plurality of inter-blade spaces, each of the inter-blade spaces being defined circumferentially between two adjacent blades of the plurality of blades, the holding system comprising a plurality of inserts, each of the inserts being configured to be inserted into each of the inter-blade spaces in a holding position so as to hold the relative position of the blades when the plurality of blades are dismantled from the disc, and wherein each of the inserts comprises:

a first member and a second member, the first and second members being configured to be disposed in an inter-blade space, the first member being disposed against a first blade, and the second member being disposed against a second blade circumferentially adjacent to the first blade; and a wedge or a bevel, configured to be inserted between the first and second members so as to hold the insert between the first and second blades.

11. The holding system according to claim 10, wherein the inserts have a thickness in a radial direction greater than or equal to 10% of the height of an airfoil of a blade in the radial direction.

12. The holding system according to claim 10, comprising a sleeve configured to be mounted on an insert of the plurality of inserts, the sleeve being configured to allow the gripping of the insert and facilitate the mounting of the insert in an inter-blade space.

13. The holding system according to claim 10, comprising a positioning ring, each insert of the plurality of inserts being configured to be applied to the positioning ring so as to hold the inserts in position.

14. The holding system according to claim 13, wherein the positioning ring comprises fastening elements to allow the fastening of the inserts on the positioning ring.

* * * * *